US009291434B2

(12) United States Patent
Tillotson et al.

(10) Patent No.: US 9,291,434 B2
(45) Date of Patent: Mar. 22, 2016

(54) METHOD AND SYSTEM FOR ELECTRONICALLY SHAPING DETONATED CHARGES

(71) Applicant: The Boeing Company, Chicago, IL (US)

(72) Inventors: Brian J. Tillotson, Kent, WA (US); Jeffrey Evan Hanneman, Woodinville, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 14/519,890

(22) Filed: Oct. 21, 2014

(65) Prior Publication Data

US 2015/0300787 A1 Oct. 22, 2015

Related U.S. Application Data

(62) Division of application No. 13/423,712, filed on Mar. 19, 2012, now Pat. No. 8,863,666.

(51) Int. Cl.
*F42B 1/02* (2006.01)
*F41H 5/007* (2006.01)
(Continued)

(52) U.S. Cl.
CPC *F42B 1/02* (2013.01); *F41H 5/007* (2013.01); *F41H 11/02* (2013.01); *F42C 19/0838* (2013.01); *F42C 19/0842* (2013.01); *F42C 19/0846* (2013.01)

(58) Field of Classification Search
CPC ..... F41H 5/007; F41H 7/042; F41H 11/02; F42B 1/02; F42C 19/0838; F42C 19/0842; F42C 19/0846
USPC ..... 102/305, 265, 270, 271, 273, 217, 216; 89/92, 36.08, 36.17; 109/37, 36
See application file for complete search history.

(56) References Cited

U.S. PATENT DOCUMENTS 3,820,461 A * 6/1974 Silvia ..... F42B 1/00 102/305
4,658,727 A 4/1987 Wilhelm et al.
(Continued)

FOREIGN PATENT DOCUMENTS

DE 977984 9/1974

OTHER PUBLICATIONS

Office Action, U.S. Appl. No. 13/423,712 (Feb. 21, 2014).
(Continued)

*Primary Examiner* — Samir Abdosh
*Assistant Examiner* — John D. Cooper
(74) *Attorney, Agent, or Firm* — Clifford Cousins

(57) ABSTRACT

A method of controlling the shape and direction of an explosion may include embedding a plurality of detonators in an explosive, and arranging the detonators in the explosive to produce a shaped explosion of the explosive in a pre-set direction and having a pre-set intensity when triggered in a selected sequence; sensing a direction of an incoming threat relative to a protected region, calculating an intercept vector for the incoming threat, and sending a signal in response thereto by a sensor; receiving information from the sensor pertaining to the intercept vector and determining a sequential firing pattern for the detonators in response to the information from the sensor by a firing sequence calculator connected to trigger the detonators; and activating the firing sequence calculator to trigger the detonators in the sequential firing pattern to generate a counteracting force substantially along the intercept vector.

21 Claims, 4 Drawing Sheets

(51) Int. Cl.
*F41H 11/02* (2006.01)
*F42C 19/08* (2006.01)

(56) References Cited

U.S. PATENT DOCUMENTS 4,823,701 A 4/1989 Wilhelm
4,848,239 A * 7/1989 Wilhelm ..... F42B 12/22 102/475
5,577,432 A * 11/1996 Becker ..... F41H 5/007 89/36.17
6,327,955 B1 * 12/2001 Kerdraon ..... F41H 5/007 89/36.17
6,622,632 B1 * 9/2003 Spivak ..... F42B 12/204 102/305
7,270,059 B2 9/2007 Roller et al.
7,684,020 B1 3/2010 Marti et al.
8,281,701 B2 * 10/2012 Zank ..... F41H 5/007 89/36.17
8,316,753 B2 * 11/2012 Beach ..... F41H 5/007 89/36.17
8,387,512 B2 * 3/2013 Warren ..... F41H 5/007 89/36.17
2010/0319526 A1 12/2010 Imholt et al.
2012/0152102 A1 * 6/2012 Tawil ..... F42C 15/40 89/36.17
2013/0092016 A1 * 4/2013 Sales ..... F41H 5/007 89/36.08

OTHER PUBLICATIONS

Notice of Allowance, U.S. Appl. No. 13/423,712 (Jun. 23, 2014).
Haug, Dieter et al.; "Abstandsaktive Hardkill-Schutzsysteme für Landfahrzeuge"; Strategie and Technik, Report Verlag GmbH, DE; vol. 54, No. 9; pp. 10-13; XP001564904 (Sep. 1, 2011).
EP, Search Report and Opinion; European Patent Application No. 13159811.2 (Jul. 22, 2015).

* cited by examiner

METHOD AND SYSTEM FOR ELECTRONICALLY SHAPING DETONATED CHARGES

FIELD

The present disclosure relates to methods and systems for controlling the shape and direction of an explosion, and more particularly, methods and systems for controlling the shape and direction of an explosion in order to refract and diminish an approaching shock wave.

BACKGROUND

A common feature of explosive ordnance is that it includes an explosive charge encased within a warhead. The warhead may be self-propelled, as the payload of a missile or rocket-propelled grenade (RPG), or it may be ballistic, as the payload of a mortar round, shell or air-to-ground bomb. Such explosive ordnance creates destruction and injury in two principal ways.

First, when detonated, the explosive charge creates a heated volume of gas and plasma that expands rapidly and disintegrates the warhead in which it is contained. Pieces of the disintegrated warhead create high-velocity shrapnel that may impact and damage surrounding structures, including vehicles, and personnel. Stationary structures may be hardened to protect against the damage caused by shrapnel. Protective armor may be applied to vehicles to lessen the damage caused by shrapnel, but such armor adds to the weight of the vehicle, which may negatively affect its performance. Body armor may be worn by individuals, but is less effective because such armor typically leaves portions of the individual, such as the head, arms and legs, unprotected.

Second, detonation of the explosive charge creates an expanding volume of hot gases and heated plasma caused by rapid combustion of the explosive charge. The outer boundary of the expanding volume of hot gases and plasma forms a pressure shock wave. Depending upon the energy released by the detonation of the explosive charge of the warhead, this shock wave may contain sufficient energy to severely damage adjacent structures, including vehicles, and cause injury or death to personnel it impacts. Stationary structures may be hardened to withstand the energy imparted by such shock waves. Adding armor to vehicles is less effective, especially with respect to lighter vehicles, which cannot carry heavy armor. Personnel may be particularly vulnerable to high-energy shock waves caused by exploding ordnance. For example, a shock wave from an explosion may at a minimum damage a person's ear drums, and at higher energy levels, can cause a concussion resulting from a person's brain impacting his skull, or death.

Accordingly, there is a need to develop a countermeasure that can lessen the destructive effect of shock waves caused by exploding ordnance. Such countermeasures preferably should be capable of deployment on the order of milliseconds once explosive ordnance has detonated.

SUMMARY

In one embodiment, a method of controlling the shape and direction of an explosion may include embedding a plurality of detonators in an explosive, and arranging the detonators in the explosive to produce a shaped explosion of the explosive in a pre-set direction and having a pre-set intensity when triggered in a selected sequence; sensing a direction of an incoming threat relative to a protected region, calculating an intercept vector for the incoming threat, and sending a signal in response thereto by a sensor; receiving information from the sensor pertaining to the intercept vector and determining a sequential firing pattern for the detonators in response to the information from the sensor by a firing sequence calculator connected to trigger the detonators; and activating the firing sequence calculator to trigger the detonators in the sequential firing pattern to generate a counteracting force substantially along the intercept vector.

In another embodiment, a method for deflecting or destroying an incoming threat to a vehicle may include embedding a plurality of detonators in an explosive, and arranging the detonators in the explosive to produce a shaped explosion of the explosive in a pre-set direction and having a pre-set intensity when triggered in a selected sequence; sensing a direction of an incoming threat relative to the vehicle, calculating an intercept vector for the incoming threat, and sending a signal in response thereto by a sensor; receiving information from the sensor pertaining to the intercept vector and determining a sequential firing pattern for the detonators in response to the information from the sensor by a firing sequence calculator connected to trigger the detonators; and activating the firing sequence calculator to trigger the detonators in the sequential firing pattern to detonate the explosive to generate a counteracting force substantially along the intercept vector.

In yet another embodiment, a method for providing an offensive weapon against an incoming threat may include embedding a plurality of detonators in an explosive, and arranging the detonators in the explosive to produce a shaped explosion of the explosive in a pre-set direction and having a pre-set intensity when triggered in a selected sequence; detecting an incoming threat relative to a protected area, and sending a signal containing distance, elevation and azimuthal information by a sensor; and triggering the detonators in a pre-set sequence determined by the signal received by a firing sequence calculator to shape and direct an explosion from the explosive toward the incoming threat to neutralize, destroy, or deter the threat.

Other objects and advantages of the disclosed method and system will be apparent from the following description, the accompanying drawings and the appended claims.

DETAILED DESCRIPTION

Figure 1:
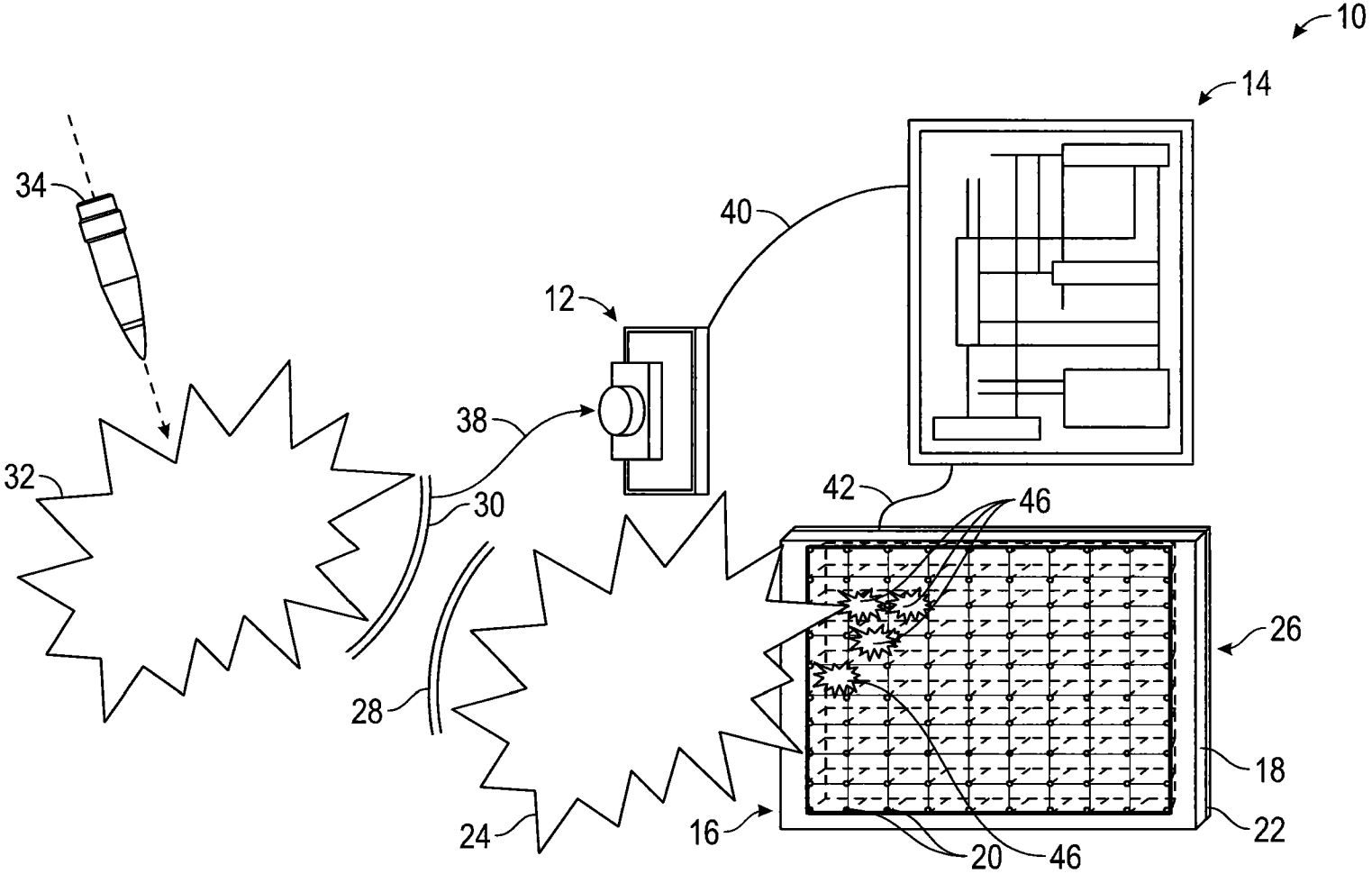
FIG. 1 is a schematic drawing of an exemplary embodiment of the disclosed system for electronically shaping detonated charges.

As shown in FIG. 1, the disclosed system for electronically shaping detonated charges, generally designated 10, may include a sensor 12, a firing sequence calculator 14 connected to the sensor, and an explosive device 16. The explosive device 16 may include an explosive 18 in which are inserted a plurality of discrete detonators 20. Each of the detonators 20 may be connected to the firing sequence calculator 14 so that it may be individually detonated in a pre-set or predetermined sequence.

Figure 2:
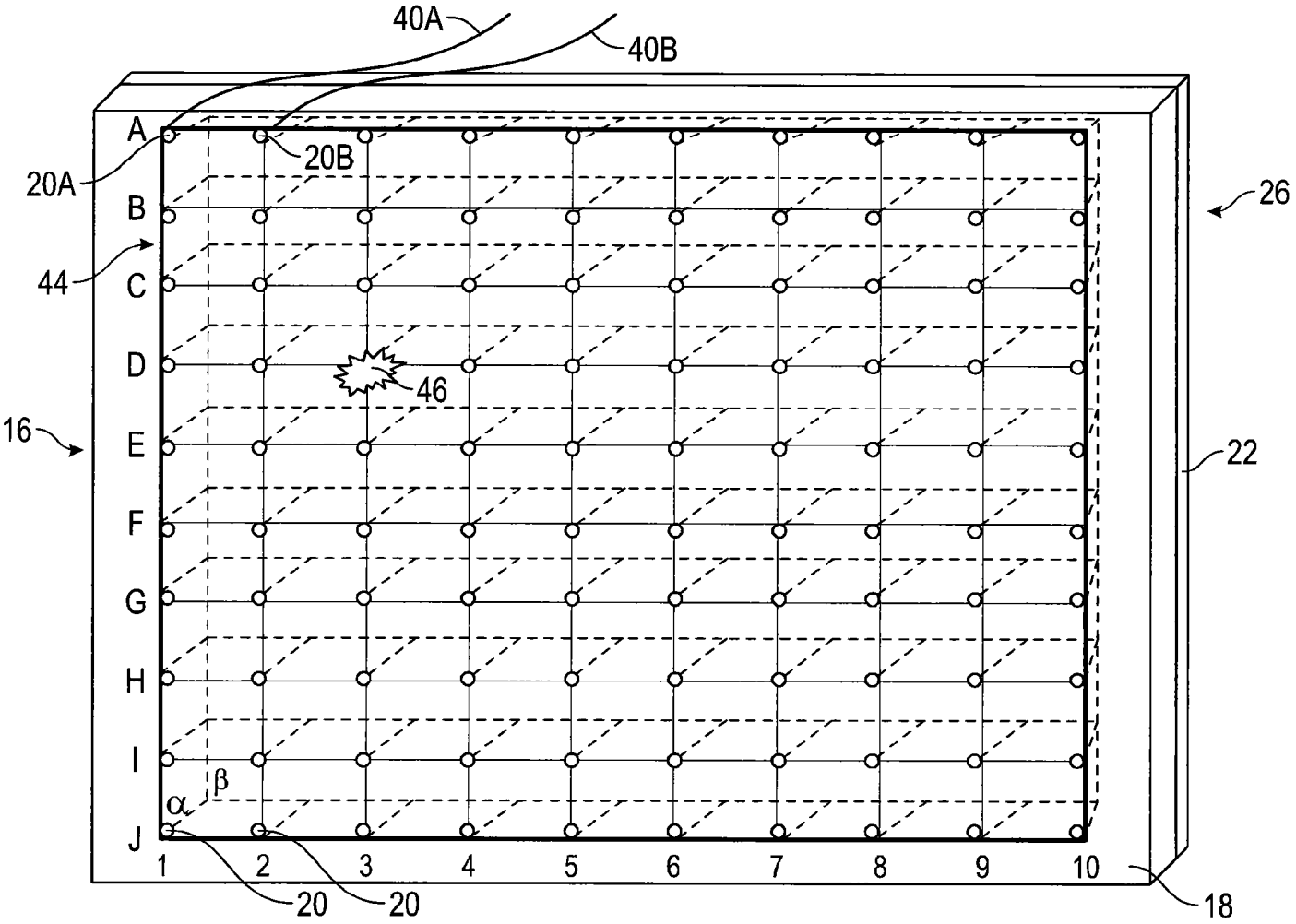
FIG. 2 is a schematic drawing of the explosive device of FIG. 1 showing details of exemplary detonator grid.

As shown in FIGS. 1 and 2, the explosive 18 may be regularly shaped. As shown in the drawing figure the explosive may be formed in the shape of a flat, oblong plate. In one aspect, the explosive 18 may be made of known material, for example a plastic explosive such as C4, PE4, or Semtex, or an explosive such as trinitrotoluene (TNT). A plastic explosive may be preferable because of its stability and moldability. In one aspect, the explosive 18 may be mounted on a substrate 22, which may be a plate of material, such as steel or Kevlar, of sufficient strength and thickness to direct the force of the explosion 24 created by detonation of the explosive 18 away from the protected region 26. In some applications, the structure or mount supporting substrate 22 also may need to be specially reinforced. The substrate 22 is shown in FIG. 2 as a substantially flat plate, but it is within the scope of the disclosure to form the substrate to have a three-dimensional shape, such as a concave shape. The explosive 18 may be attached to the concave side of such a plate so that the hot gas 28 generated by the explosion 24 may act as a counteracting force that may be focused toward the shock wave 30 from an explosion 32 resulting from the detonation of a warhead of an incoming threat 34.

The protected region 26 may be located behind the explosive device 16 and may include a vehicle 36 (see FIG. 3) or personnel (not shown). If the explosive device 16 includes a substrate 22, the protected region 26 may be on a side of the substrate opposite the explosive 18.

The detonators 20 may be arranged in the explosive 18 in a regular grid pattern; that is, the detonators may be arranged in substantially evenly spaced and aligned rows and columns in the explosive so that they may be dispersed substantially evenly throughout the explosive. Although the detonators 20 are shown arranged in substantially a single plane in the explosive 18, it is to be understood that the detonators may be arranged in a three-dimensional pattern in the explosive such that the detonators may form a three-dimensional prism shape within the explosive, and not depart from the scope of the disclosed system 10. It is also to be understood that the arrangement of detonators 20 may take a different pattern in the explosive 18, depending upon the desired shape of the shock wave to be created by detonating the explosive. In this manner, detonators 20 may be arranged in one of a one-dimensional, two-dimensional, or three-dimensional pattern.

The sensor 12 may be selected to detect the explosion 32 from the incoming threat 34, which may include a mortar round, artillery shell, guided missile, RPG or air-to-ground bomb, as well as detonation of a stationary explosive device such as an improved explosive device (IED) or a land mine. In each case, the sensor 12 preferably is selected to detect detonation of the incoming threat 34 before the resultant shock wave 30 reaches the protected region 26. In one aspect, the sensor may be selected to detect electromagnetic radiation 38 emitted by the explosion 32 because it travels much faster than the shock wave 30.

The sensor 12 may be selected to detect any subset of the electromagnetic spectrum emitted by the explosion 32, such as microwave bursts; flashes of infrared, visible and ultraviolet light; and x-ray bursts. For example, it has been found that IEDs may emit x-rays during detonation. Such an x-ray signature may be detected by the sensor 12 in advance of the shock wave 30 so that the system 10 would have time to deploy. In one aspect, a sensor 12 may be selected to detect two or more different types of electromagnetic radiation 38 to minimize deployment of the system 10 in response to false positives. In this manner, system 10 may include at least two different types of sensors. In another aspect, the system 10 may include a sensor 12 selected to detect bursts of electromagnetic radiation 38 in the form of gamma rays or neutrons, in addition to or instead of x-rays or microwaves, such that the system may deploy in response to an incoming shock wave from a nuclear detonation.

In one aspect, the sensor 12 not only may detect the explosion 32, but also estimate one or more of the magnitude, distance, elevation angle and azimuthal position. These estimates may prevent the sensor 12 from signaling the firing sequence calculator 14 to detonate the explosive 18 when the explosion is too small or distant to be a threat to the protected region 26. When the location of the explosion 32 is determined to be sufficiently close to present a threat to the protected region 26, the sensor 12 may send a signal over cable 40 to the firing sequence calculator 14, which may send instructions over cable 42 to the detonators 20 of the explosive device 16.

As shown in FIG. 2, the explosive device 16 may include detonators 20 arranged in a grid pattern 44 in the explosive 18. In one aspect, the arrangement may be in the form of a grid pattern, which, for purposes of illustration is labeled A-J on the Y-axis and 1-10 on the X-axis. Each of the detonators 20 is connected to the firing sequence calculator 14 (see FIG. 1) by a discrete cable 40. As illustrated in FIG. 2, detonators 20A and 20B, located at grid co-ordinates 1A and 2A, may be connected by cables 40A, 40B, respectively, to firing sequence calculator 14. Although not shown for clarity, each of the other detonators 20 also may be connected by its own cable to the firing sequence calculator 14.

In one aspect, the grid pattern 44 may be in the shape of a rectangular prism. However, it is within the scope of the disclosure to provide grid patterns 44 in different shapes, for example as a radial grid. In one aspect, the grid pattern 44 is two dimensional. However, it is within the scope of the disclosure to provide detonators 20 in a three-dimensional pattern. In such an embodiment, as shown in FIG. 2, detonators 20A and 20B would be located at 1A$\alpha$ and 2A$\alpha$, respectively. Other detonators (not shown) may be located at grid 44 co-ordinates 1A$\beta$ and 2A$\beta$, for example, on a Z axis. It is also within the scope of the disclosure to provide detonators 20 in a one-dimensional pattern. In such an embodiment, for example, detonators may be arranged in a single row F, colum 5, or along the Z axis at co-ordinate F5, or along a skewed line relative to grid 44.

The firing sequence calculator 14 (FIG. 1) may determine an optimum sequential firing pattern for the detonators 20, such as a pattern corresponding to a phased array transmitter of acoustic energy, so that the system 10 may direct the vector of the explosion 24, and resultant volume of hot gas 28, in a desired direction, which may be toward explosion 32 and shock wave 30. The firing sequence calculator 14 may include an onboard chip or circuit board that may compute, via a code sequence received from the sensor 12, a desired detonator 20 firing sequence. In the alternative, the firing sequence calculator 14 may select a firing sequence from among a plurality of stored firing sequences in response to the code sequence received from sensor 12. That firing sequence may be transmitted to the grid 44 of detonators 20.

In one aspect, the system may operate as follows, as illustrated in FIG. 1. Incoming threat 34, which may be a bomb dropped from an aircraft, a howitzer shell, a mortar shell, land mine or IED, detonates to form explosion 32. The explosion 32 also may transmit radiation 38, which may include subatomic particles such as neutrons, that is detected by sensor 12. The sensor 12 is programmed to sense the radiation 38 and from it may determine the magnitude and location of the explosion 32. From this information (i.e., from one or more of the magnitude, direction and type of radiation) the sensor 12 may determine that the explosion 32 presents a threat to the protected region 26. It is within the scope of the disclosure to provide the system 10 with multiple sensors 12 (not shown) that may provide a triangulation feature.

The sensor 12 transmits information over cable 40 to the firing sequence calculator 14, which uses location information to create an appropriate firing sequence for the detonators 20 in the grid 44 (see FIG. 2). The firing sequences—and corresponding electrical pulses—may then be sent to the detonators 20, which will then fire in the prescribed order, indicated at 46 in FIGS. 1 and 2 to create explosion 24. The firing sequence of the detonators 20 directs the volume of hot gas 28 toward the shock wave 30 from the explosion 34.

In one aspect, the explosive 18 may be shaped to fit a surface on which it is mounted, rather than be shaped to effect a desired explosion 24 and directed volume of hot gas 28. For example, in FIG. 3 the explosive 18 is formed in the shape of a plate that is mounted on a substantially vertical surface behind a plate (not shown) inside the door 48 of a vehicle 36. However, by triggering the detonators 20, arranged in a grid array 44, in a pre-set order, the resulting explosion 24 (FIG. 1) may be shaped as desired to direct a resultant hot gas 28 toward the shock wave 30 of explosion 32 from an incoming threat 34.

Figure 3:
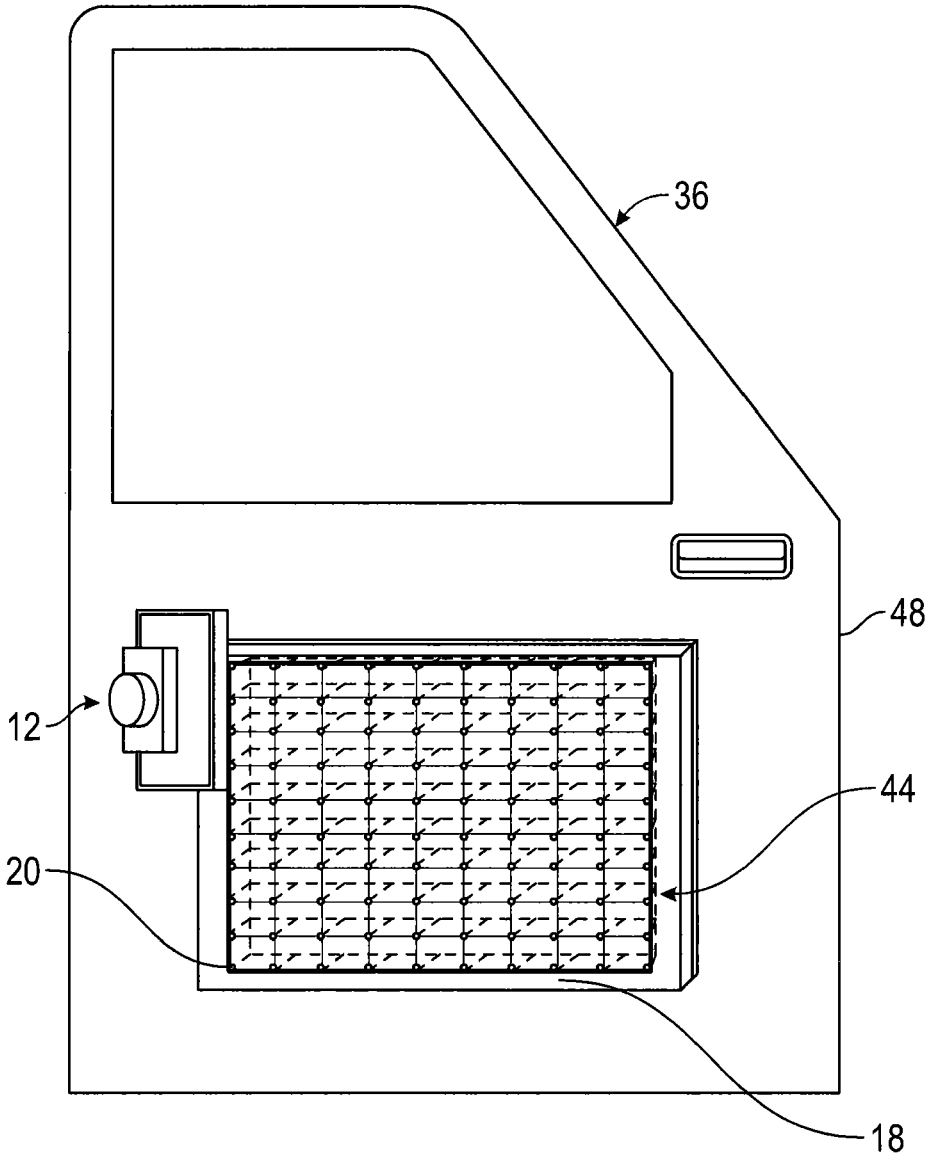
FIG. 3 is a schematic drawing of an exemplary embodiment the explosive device of FIG. 2, shown mounted on a door of a vehicle.

In the embodiment of FIG. 3, the sensor 12 may also be positioned within the door 48, of a vehicle 36, which in one aspect may be an armored vehicle. In this embodiment, it is preferable to provide the explosive 18 with a substrate 22 (see FIG. 2) that provides reinforcement to protect the vehicle and its occupants from the explosion 24. In some applications, the structure or mount supporting substrate 22 may also need to be specially reinforced. In one aspect, the substrate 22 may be made of steel/titanium, and/or be parabolic in shape. In one aspect, the substrate 22 also may protect the occupants of the vehicle 36 in the event that the explosive 18 is detonated maliciously, as by being shot at by a gun.

In one aspect, the sensor 12 of the system 10 may be selected to detect an incoming threat 34 in the form of an RPG, then signal the firing sequence calculator 14 that in turn triggers detonators 20 embedded in explosive 18. The direction of the incoming threat 34 would be fed to the firing sequence calculator 14 that would trigger detonators 20 in a pattern that would create a shaped explosion 24 that would deflect or destroy the threat.

In one aspect, the system 10 may be used as an offensive weapon against an incoming threat. In one exemplary embodiment, the sensor 12 may detect an incoming threat in the form of, for example, hostile personnel or vehicle. The sensed signature may include, for example infrared radiation from body heat of the hostile personnel or hostile vehicle, movement of hostile personnel or vehicle, or the flash of electromagnetic radiation from a weapon held by hostile personnel, such as a rifle or machine gun, or mounted on the hostile vehicle. The sensor 12 may detect the location of the hostile personnel relative to the protected area 26 or vehicle 36 and send a signal containing distance, elevation and azimuthal information to firing sequence calculator 14. Firing sequence calculator 14 may then trigger detonators 20 in a pre-set sequence determined by information received from sensor 12. The resultant explosion 24 may be shaped and directed by firing sequence calculator 14 toward the incoming threat to neutralize, destroy or deter the threat.

Figure 4A:
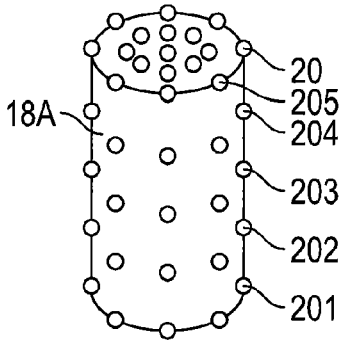
FIGS. 4A, 4B, and 4C show perspective, plan and elevational views, respectively, of an aspect of the disclosed explosive device in the form of a cylinder with an arrangement of detonators.
Figure 4B:
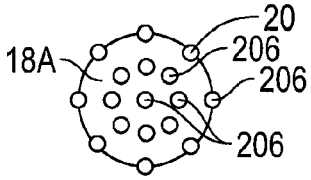
Figure 4C:
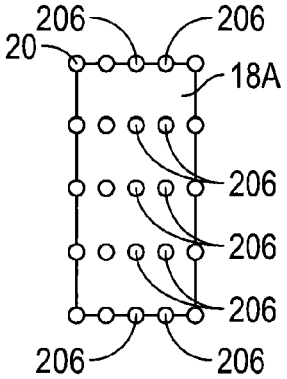

As shown in FIGS. 4A-4C, the explosive 18A may be formed in regular shapes other than in a plate shape—in this embodiment it may take the form of a cylinder. The detonators 20 may be arranged in a grid 44A or pattern that may be in the form of a column of concentric rings of detonators extending through the volume of the explosive. The pattern may have linear, cylindrical, or spherical symmetry. For the sake of clarity, only the concentric ring appearing on the top surface of the explosive 18A in FIG. 4A is shown in full. It is to be understood that rings 201, 202, 203 and 204 may have the same number of detonators 20 in substantially the same arrangement as concentric rings 205. It is also within the scope of the disclosure to provide spacing and arrangement of detonators 20 that varies among rings 201-205, or to provide fewer or greater numbers of rings.

In one aspect, as shown in FIG. 4A, if the rings of detonators 20 are detonated in a series such that ring 201 is detonated first, followed sequentially separated by microsecond time delays by rings 202, 203, 204 and 205, an explosive force may be strongly projected upward from the explosive 18A, as shown in the drawing figure. In another aspect, shown in FIGS. 4B and 4C, if only detonators 206 are fired with microsecond delays, the resultant explosion would be concentrated in a wide vertical line generally to the left in FIG. 4B.

Figure 5:
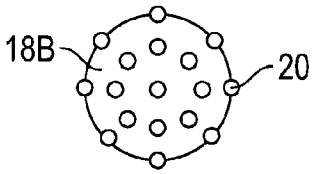
FIG. 5 shows an elevational view of an aspect of the disclosed explosive device in the form of a sphere with an arrangement of detonators.

As shown in FIG. 5, the explosive 18B may be formed generally in the shape of a sphere. The detonators 20 may be arranged in concentric rings or radii expanding outward from the center of the sphere. With this shape of explosive 18B, it may be possible to fire the detonators from the outside in, thereby minimizing the explosive force, or from the inside out, thereby maximizing the force of the concussion wave 28 (FIG. 1), or patterned to create a conical or directed force of a pre-set trajectory.

Figure 6A:
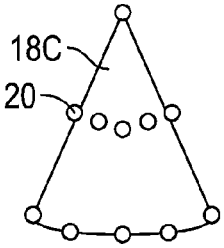
FIGS. 6A, 6B, and 6C show perspective, mid-sectional and bottom views, respectively, of an aspect of the disclosed explosive device in the form of a cone with an arrangement of detonators.
Figure 6B:
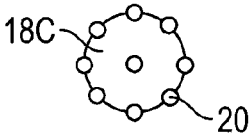
Figure 6C:
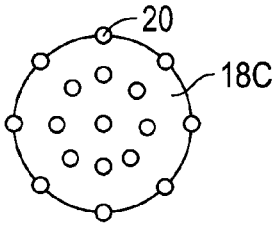

As shown in FIGS. 6A-6C, the explosive 18C may be formed in the shape of a cone. Detonators may be arranged in concentric rings through the volume of the cone. The explosion 24 may be shaped as desired by sequencing the firing of successive rings of the detonators 20.

Figure 7A:
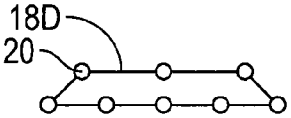
FIGS. 7A, 7B, and 7C show elevational, plan and bottom views, respectively, of an aspect of the disclosed explosive device in the form of a trapezoid or truncated pyramid with an arrangement of detonators.
Figure 7B:
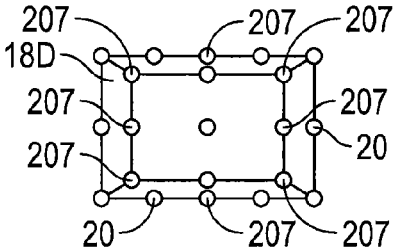
Figure 7C:
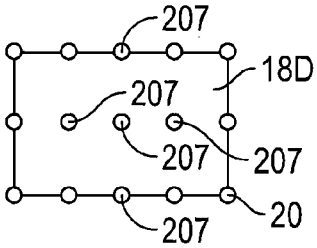

As shown in FIGS. 7A-7C, the explosive 18D may be formed in the shape of a pyramidal frustum. Detonators 20 may be placed in stacked grids through the elevation of the frustum. Again, for clarity only grid arrangements on the top (FIG. 7B) and bottom (FIG. 7C) of explosive 18D are shown in full, it being understood that this embodiment may contain several grid arrangements of detonators through its height, or may contain only what is actually shown. In one aspect, by triggering the detonators 207 a parabolic explosion projecting outward through the top of the explosive 18D; that is, outward from the plane of the drawing of FIG. 7B, may be created.

These particular embodiments are shown to illustrate the general principle of embedding detonators 20 in a pattern within an explosive 18 having a particular shape, then initiating the detonators in a sequence to produce an explosion of a desired, pre-set shape that may be directed toward an incoming hostile threat 34. Other explosive shapes and detonator patterns are included within the scope of this disclosure. In one particular aspect, the described method and system may be used to counteract the force of a shock wave 30 created by detonation of an explosive associated with an incoming threat 32. By shaping and directing a counteractive explosion 24 toward the explosion 32 resulting from an incoming threat 34, the described method and system may create an expanding volume of heated gas 28 that may be directed toward the shock wave from the incoming threat.

The volume of heated gas 28 created by the explosion 24 of the disclosed method and system may change the acoustic refractive index at the boundary between ambient air and the outer boundary of the shock wave from the counteractive explosion, thus deflecting the shock wave 30 from the incoming threat 34 away from the intended target. The volume of heated gas 28 may act as a lens to "steer" the shock wave 30 and hot gases from the incoming threat 34 away from the intended target. The shock wave 30 from the incoming threat 34 also may be dispersed and diminished in intensity from the maximum force that otherwise would impact the intended target.

According to one embodiment, a method may include sensing the direction and velocity of an incoming threat 34, calculating an intercept vector for the threat, and activating an explosive detonation grid 44 within an explosive charge 18 to detonate the charge in a manner that generates an explosion 24 having an intercepting force directed along the intercept vector. In one aspect, activating the explosive detonation grid 44 may include activating a plurality of discrete detonators 20 in a pre-set sequence in order to create an intercepting explosive force of a desired shape.

According to another embodiment, a system 10 for controlling the shape and direction of an explosion 24 may include a sensor 12 configured to detect the direction and velocity of an incoming threat 34, an explosive device 16 including a detonator grid 44, the detonator grid being configured to selectively detonate the explosive device to produce a shaped explosion 24 in a selected direction and having a selected intensity, and a firing sequence calculator 14 configured to activate the detonator grid to produce the shaped explosion and create a counteracting force in response to the incoming threat. In one aspect, the explosive device 16 may include a reinforcement or hardened substrate 22, such as a steel plate, to which explosive material 18 is attached. The explosive device 16 may be oriented such that the substrate 22 is between the explosive material 18 and the item to be protected 26 to ensure that when the explosive is detonated by the detonator grid, the explosive force is directed away from the item to be protected and toward the incoming threat 34.

According to yet another embodiment, a vehicle 36 may include a system 10 for controlling the shape and direction of an explosion 24 having a sensor 12 configured to detect the direction and velocity of an incoming threat 34, an explosive device 16 including a detonator grid 44, the detonator grid being configured to selectively detonate the explosive device to produce a shaped explosion 24 in a selected direction and having a selected intensity, and a firing sequence calculator 14 configured to activate the detonator grid to produce the shaped explosion and create a counteracting force in response to the incoming threat. In one aspect, at least the explosive device may be mounted on a door 48 of the vehicle 36 and may include a reinforcement or hardened substrate 22, such as a steel plate, to which explosive material 18 is attached. The explosive device 16 may be oriented such that the substrate 22 is between the explosive material 18 and the vehicle 36 to ensure that when the explosive material is detonated by the detonator grid, the explosive force is directed away from the vehicle 36 and toward the incoming threat 34. In one aspect, the sensor 12 also may be mounted on the vehicle door 48. The vehicle 36 may include a cover to protect the explosive device 16.

In one aspect, the sensor 12 is selected to detect an explosion 32 caused by an incoming threat 34 before the resultant shock wave 30 reaches the item 26 the system 10 is to protect. The sensor 12 may be selected to detect electromagnetic radiation 38 created by detonation of an explosive associated with the incoming threat, because such radiation travels at light speed and will reach the sensor before the shock wave. The electromagnetic radiation 38 may include microwave bursts, and flashes of radiation in one or more of the x-ray, infrared, visible light and ultraviolet portions of the electromagnetic spectrum.

In one aspect, the detonator grid 44 may include a plurality of discrete detonators 20 arranged in a pattern embedded in the explosive material 18, and in a further aspect, the pattern may be in the shape of a regular grid. The firing sequence calculator 14 may be activated to trigger the detonators 20 in the sequential firing pattern by determining the optimum sequential firing pattern for the detonators, and triggering the detonators in the regular grid pattern in the optimal sequential firing pattern. In other aspects, the detonators 20 may be arranged in rings, concentric circles or a radial pattern. The explosive material 18 may be formed in the shape of a plate, a cylinder, a sphere, a cone, a truncated pyramid or other regular geometric shape. The selected shape of the explosive material 18 may be determined by the surface or structure on which it is to be mounted, and by the desired shaped explosion. The pattern of detonators 20 in the explosive material 18 may be selected depending on the shape of the explosive material and by the desired shaped explosion.

In one aspect, each detonator 20 may be individually connected to the firing sequence calculator 14 so that the firing sequence calculator may create a desired sequence of detonator activation. In another aspect, groups of detonators 20 may be connected to the firing sequence calculator 14 so that the groups of detonators may be triggered sequentially to create a desired shaped explosion.

The system 10 described herein may be used both offensively and defensively in response to a threat to create an explosion having a pre-set shape by selectively triggering a plurality of detonators embedded in an explosive and project a volume of hot gas toward the threat. While the methods and forms of apparatus described herein may constitute preferred aspects of the disclosed method and apparatus, it is to be understood that the invention is not limited to these precise aspects, and that changes may be made therein without departing from the scope of the invention.

What is claimed is:

1. A method of controlling the shape and direction of an explosion, the method comprising:

embedding a plurality of detonators in an explosive, and arranging the detonators in the explosive to produce a shaped explosion of the explosive in a pre-set direction and having a pre-set intensity when triggered in a selected sequence;

sensing a direction of an incoming threat relative to a protected region, calculating an intercept vector for the incoming threat, and sending a signal in response thereto by a sensor;

receiving information from the sensor pertaining to the intercept vector and determining a sequential firing pattern for the detonators in response to the information from the sensor by a firing sequence calculator connected to trigger the detonators; and activating the firing sequence calculator to trigger the detonators in the sequential firing pattern to generate a counteracting force substantially along the intercept vector.

2. The method of claim 1, wherein activating the firing sequence calculator controls both the direction and intensity of the counteracting force.

3. The method of claim 2, wherein embedding a plurality of detonators in the explosive includes embedding a plurality of detonators in a regularly shaped explosive.

4. The method of claim 3, wherein embedding a plurality of detonators in the explosive includes arranging the detonators in one of a linear, rectangular, cylindrical, conical, or spherical pattern in the explosive.

5. The method of claim 4, wherein arranging the detonators includes arranging the detonators in one of a one-dimensional, two-dimensional, or three-dimensional pattern.

6. The method of claim 1, wherein activating the firing sequence calculator to trigger the detonators in the sequential firing pattern generates the counteracting force to disperse and diminish an intensity of an incoming shock wave generated by the incoming threat.

7. The method of claim 1, further comprising mounting the explosive on a substantially vertical surface.

8. The method of claim 7, wherein mounting the explosive includes mounting the explosive conformal to the surface.

9. The method of claim 7, wherein mounting the explosive includes forming the explosive in a flat, oblong shape.

10. The method of claim 1, wherein embedding the plurality of detonators includes arranging the plurality of detonators in a regular grid pattern in the explosive; and activating the firing sequence calculator to trigger the detonators in the sequential firing pattern includes determining an optimum sequential firing pattern for the detonators, and triggering the detonators in the regular grid pattern in the optimal sequential firing pattern.

11. The method of claim 1, wherein sensing a direction of an incoming threat relative to a protected region includes detecting an explosion by evaluating electromagnetic radiation selected from one of infrared light, visible light, ultraviolet light, microwaves, and X-Rays.

12. The method of claim 1, wherein sensing a direction of an incoming threat relative to a protected region includes sensing the direction of the incoming threat using at least two different types of sensors.

13. The method of claim 12, wherein sensing a direction of an incoming threat relative to a protected region includes sensing the direction of a shock wave from an explosion.

14. The method of claim 13, wherein sensing a direction of an incoming threat relative to a protected region by the sensor includes estimating one or more of the magnitude, distance, elevation angle and azimuthal position of the explosion.

15. The method of claim 1, wherein embedding a plurality of detonators in an explosive includes arranging the detonators in a pattern within the explosive; and wherein activating the firing sequence calculator to trigger the detonators in the sequential firing pattern includes independently activating the detonators by the firing sequence calculator.

16. A method for deflecting or destroying an incoming threat to a vehicle, the method comprising:

embedding a plurality of detonators in an explosive, and arranging the detonators in the explosive to produce a shaped explosion of the explosive in a pre-set direction and having a pre-set intensity when triggered in a selected sequence;

sensing a direction of an incoming threat relative to the vehicle, calculating an intercept vector for the incoming threat, and sending a signal in response thereto by a sensor;

receiving information from the sensor pertaining to the intercept vector and determining a sequential firing pattern for the detonators in response to the information from the sensor by a firing sequence calculator connected to trigger the detonators; and activating the firing sequence calculator to trigger the detonators in the sequential firing pattern to detonate the explosive to generate a counteracting force substantially along the intercept vector.

17. The method of claim 16, further comprising mounting the explosive on the vehicle.

18. The method of claim 17, wherein mounting the explosive on the vehicle includes providing the explosive with a substrate that provides reinforcement to protect the vehicle and occupants of the vehicle from the counteracting force of the explosive.

19. The method of claim 16, further comprising mounting the sensor on the vehicle.

20. The method of claim 19, wherein mounting the sensor on the vehicle includes mounting the sensor within a door of the vehicle.

21. A method for providing an offensive weapon against an incoming threat, the method comprising:

embedding a plurality of detonators in an explosive, and arranging the detonators in the explosive to produce a shaped explosion of the explosive in a pre-set direction and having a pre-set intensity when triggered in a selected sequence;

detecting an incoming threat relative to a protected area, and sending a signal containing distance, elevation and azimuthal information by a sensor; and triggering the detonators in a pre-set sequence determined by the signal received by a firing sequence calculator to shape and direct an explosion from the explosive toward the incoming threat to neutralize, destroy, or deter the threat.

* * * * *